US012467712B2

(12) United States Patent
Strother

(10) Patent No.: US 12,467,712 B2
(45) Date of Patent: Nov. 11, 2025

(54) CAM ADJUSTER FOR COMPOUND BOW

(71) Applicant: Kevin Strother, Twin Falls, ID (US)

(72) Inventor: Kevin Strother, Twin Falls, ID (US)

( * ) Notice: Subject to any disclaimer, the term of this patent is extended or adjusted under 35 U.S.C. 154(b) by 149 days.

(21) Appl. No.: 18/611,625

(22) Filed: Mar. 20, 2024

(65) Prior Publication Data

US 2025/0297826 A1 Sep. 25, 2025

(51) Int. Cl.
*F41B 5/10* (2006.01)

(52) U.S. Cl.
CPC ..... *F41B 5/105* (2013.01)

(58) Field of Classification Search
CPC ..... F41B 5/10; F41B 5/105; F41B 5/1403; Y10S 124/90
USPC ..... 124/25.6, 900
See application file for complete search history.

(56) References Cited

U.S. PATENT DOCUMENTS 4,669,445 A * 6/1987 Schaar ..... F41B 5/10 124/900
5,535,727 A * 7/1996 Helmuth ..... F41B 5/10 124/900
5,649,522 A * 7/1997 Troncoso ..... F41B 5/10 124/900
6,415,780 B1 * 7/2002 Proctor ..... F41B 5/10 124/900
6,871,643 B2 * 3/2005 Cooper ..... F41B 5/10 124/900
6,964,271 B2 * 11/2005 Andrews ..... F41B 5/10 267/153
7,938,109 B1 * 5/2011 Larson ..... F41B 5/10 124/25.6
7,971,582 B1 * 7/2011 Larson ..... F41B 5/10 124/900
8,069,848 B1 * 12/2011 Larson ..... F41B 5/10 124/900
8,528,534 B2 * 9/2013 McPherson ..... F41B 5/14 124/86
9,115,953 B1 * 8/2015 Huang ..... F41B 5/105
9,528,788 B2 * 12/2016 McPherson ..... F41B 5/14
9,683,806 B1 * 6/2017 Yehle ..... F41B 5/105
10,126,087 B1 * 11/2018 Grace ..... F41B 5/123
10,371,480 B1 * 8/2019 Huang ..... F41B 5/10
11,486,674 B2 * 11/2022 McPherson ..... F41B 5/1403
11,536,532 B1 * 12/2022 Grace ..... F41B 5/1403
11,821,708 B1 * 11/2023 Hansen ..... F41B 5/1403
(Continued)

FOREIGN PATENT DOCUMENTS

WO WO-2024178290 A1 * 8/2024 ..... F41B 5/1403

*Primary Examiner* — Alexander R Niconovich
(74) *Attorney, Agent, or Firm* — Eric B. Fugett; Mark. A. Pitchford; Pitchford Fugett, PLLC

(57) ABSTRACT

In a compound bow, an axle, having threaded ends, is pushed through a hole in a cam. Cam spacers, having internal threads, are screwed onto the ends of the axle until the ends of the cam spacers abut the cam. The cam can rotate freely around the unthreaded middle portion of the axle. The ends of the cam spacers go into holes in limb brackets attached to the bow's resilient limb ends. In one embodiment, the ends of the cams are threaded, and a nut is tightened over the thread to shift the cam spacers and cam left or right relative to the limb brackets. In another embodiment, the cam spacers and limb brackets are threaded, and turning the cam spacer shifts the cam left or right. In both embodiments, the cam position is precisely adjusted and very stable.

17 Claims, 7 Drawing Sheets

(56) References Cited

U.S. PATENT DOCUMENTS

| | | | | |
|---|---|---|---|---|
| 12,130,112 | B1 * | 10/2024 | Hayes | F41B 5/1403 |
| 12,163,757 | B2 * | 12/2024 | Grace | F41B 5/10 |
| 2014/0352678 | A1 * | 12/2014 | Howard | F41B 5/10 124/86 |
| 2017/0370673 | A1 * | 12/2017 | Yehle | F41B 5/10 |
| 2020/0158461 | A1 * | 5/2020 | Romero | F41B 5/105 |

* cited by examiner

CAM ADJUSTER FOR COMPOUND BOW

CROSS-REFERENCE TO RELATED APPLICATIONS

This application claims priority to provisional application Ser. No. 63/577,535, having a filing date of Apr. 27, 2023, by Kevin Strother.

FIELD OF THE INVENTION

This invention relates to compound bows for archery and, in particular, to a method and structure for laterally aligning the cams of the bow relative to the bow's resilient limbs.

BACKGROUND

FIG. 1 illustrates a prior art compound bow 10 described in U.S. Pat. No. 9,683,806, incorporated herein by reference. This bow 10 can be easily modified to include the present invention.

The bow 10 includes a rigid riser 12, a space 14 for an arrow rest, a grip 16, upper and lower resilient limbs 18 and 20, a bow string 22, cables 24, an upper cam 26, and a lower cam 28. The limbs 18 and 20 terminate in prongs that support the cams 26 and 28. The cams 26 and 28 rotate around their respective axles 29. When the archer nocks an arrow in the bow string 22 and pulls the bow string 22 back, the cams 26 and 28 rotate asymmetrically around their respective axles to bend the limbs 18 and 20. The asymmetry of the cams 26 and 28 result in the pull-back tension being greatly reduced when the bow string 22 is in the full pull-back position, allowing the archer to more easily maintain the full pull-back position while aiming the arrow at the target. Once released, the cams 26 and 28 rotate and the limbs accelerate the arrow forward.

It is imperative that the cams 26 and 28 are perfectly aligned with respect to the limbs 18 and 20 and with respect to each other so that the bow string 22, when released, moves in an optimal path toward the target. For precision shooting, tolerances in the bow structure may require some amount of lateral adjustment of the cams 26 and 28 with respect to the limbs 18 and 20.

FIG. 2 is a close-up front view of the axle 29 supporting the top cam 26. Left and right axle brackets 30 and 32 are attached to the prongs of the upper limb 18. The axle 29 is fully threaded and screws through the two brackets 30 and 32. An end of the axle 29 has a hex wrench opening. The cam 26 is then set in its position between the brackets 30 and 32 by placing two snap rings 34 and 36 against both sides of the cam 26. A snap ring is a thin resilient piece of metal that is spread apart with a special type of hand tool and then resiliently closes. The snap rings 34 and 36 enter a groove in the axle's thread. The cam 26 can then rotate freely around the axle 29. The axle 29 is set by hex screws 38 and 39 in the brackets 30 and 32.

FIG. 3 is a side view of the cam 26, the bow string 22, cables 24, and axle 29.

In the example of the prior art of FIG. 2, the snap rings 34 and 36 must snap into the diagonal grooves in the axle 29, and the snap rings 34 and 36 result in some play in the cam 26. The snap rings 34 and 36 may also inadvertently slip and loosen. Therefore, it is desirable to precisely adjust the lateral position of a cam in a compound bow without the use of snap rings.

There are many different types of compound bows. Some other types of bows laterally adjust the cam on the axle using different width spacers. This type of adjustment needs a bow press machine to bend the bow to loosen the tension. Additionally, due to the limited choice of thicknesses of the spacers, the adjustment may not be optimal. Therefore, what is also needed is a technique to precisely adjust the lateral position of a cam in a compound bow so that there is no need to use a bow press to release the tension in the bow.

Ideally, an improved system will enable the archer to easily adjust the cams in the field and then test the bow.

SUMMARY

In one embodiment of the invention, limb brackets having internal threads are attached to the limbs of a compound bow. An axle having threaded ends is inserted through the conventional cam. Cam spacers have an internal thread for receiving the threaded ends of the axle. The cam spacers are screwed onto the axle ends and lightly abut the outside surface of the cam so the cam can rotate freely about the axle. The cam spacers have an external thread and are screwed through the limb brackets so that the threaded ends of the cam spacers extend slightly beyond the outer edges of the limb brackets. To move the cam left or right, a hex wrench (or Allen wrench) is inserted in one end of the cam spacer and turned, which rotates and moves both cam spacers and the cam left or right with respect to the limb brackets for precise positioning of the cam.

In another embodiment, the limb brackets do not have an internal thread. The cam spacers only have an external thread near their ends, where the external threads protrude out of the limb brackets. A nut having a hex wrench opening is then tightened on the ends of each cam spacer to push the cam spacers left or right to adjust the cam position. A worm gear may also be used to move the cam spacers relative to the limb brackets.

In another embodiment, the axle is secured to the cam spacers by a socket cap screw engaging internal threads in the axle.

In all embodiments, there is no need for a bow press when adjusting the position of the cam. A manufacturer of compound bows may easily modify their current design of bows to include the present invention, where only one or two holes in the limbs may be needed to bolt the limb brackets to the limbs.

BRIEF DESCRIPTION OF THE DRAWINGS

FIG. 4 also shows a front view of a conventional cam.

Elements that are the same or equivalent are labelled with the same numerals.

DETAILED DESCRIPTION

Figure 4:
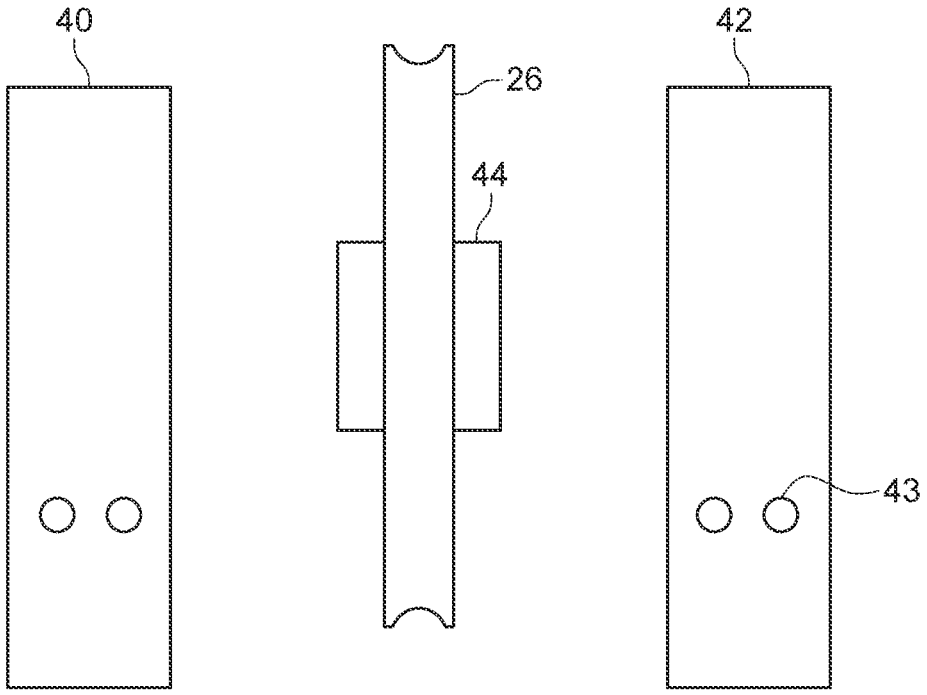
FIG. 4 is a simplified drawing of an end of a limb of a bow with two holes formed in the limb for mounting limb brackets.

FIG. 4 illustrates resilient limb ends 40 and 42 of a compound bow. The remainder of the bow can be conventional. The invention applies equally to the upper and lower cams, and only the upper cam embodiment will be described. Two holes 43 are formed in each limb end 40 and 42 to secure limb brackets to the limb ends 40 and 42 with screws or bolts. A conventional cam 26 typically has fixed pieces 44 around its axle hole for the cable 24 and for reinforcement. The conventional cam 26 is simplified and its diameter is reduced.

Figure 5:
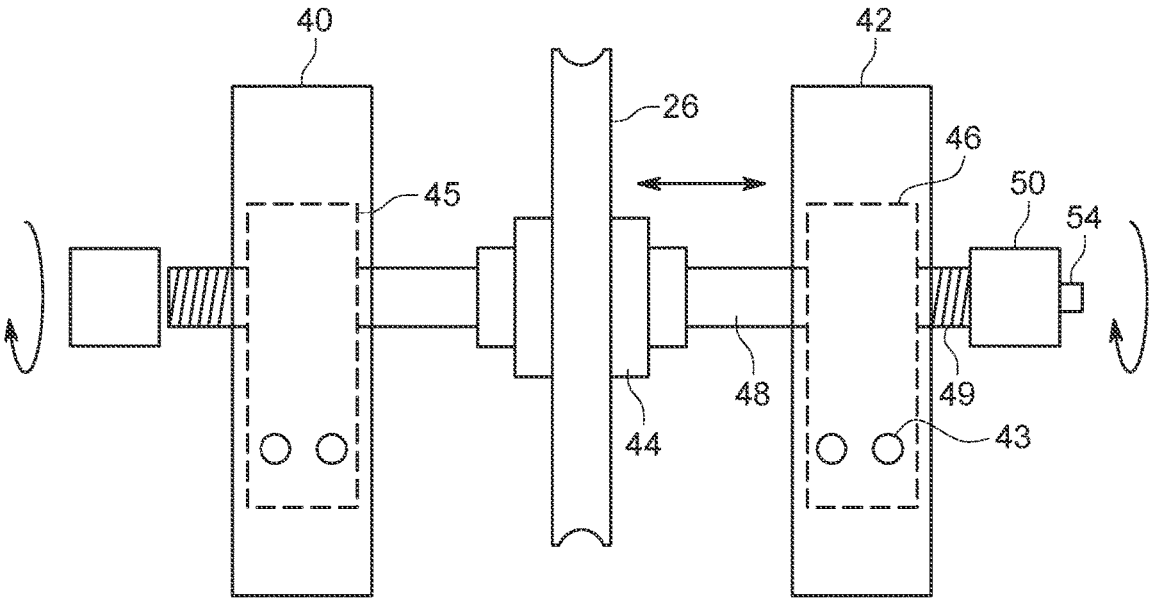
FIG. 5 illustrates one embodiment of the invention where cam spacers screw onto ends of an axle and extend through limb brackets to allow a nut to be turned to shift the cam spacers left and right. A worm gear may instead be used to shift the cam spacers.

FIG. 5 shows the structure of FIG. 4 utilizing one embodiment of the present invention.

Figure 6:
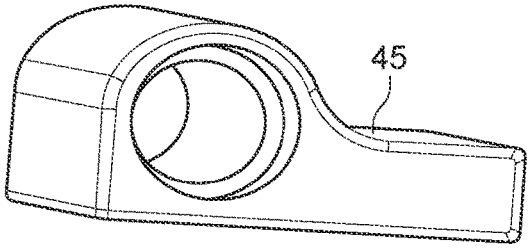
FIG. 6 illustrates an unthreaded left limb bracket.
Figure 7:
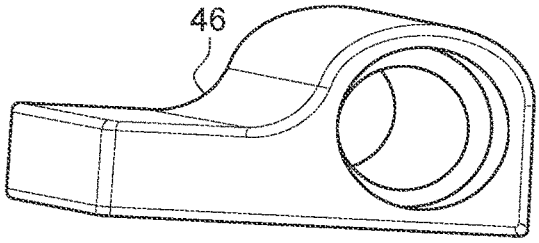
FIG. 7 illustrates an unthreaded right limb bracket.

FIGS. 6 and 7 show limb brackets 45 and 46 that have two holes (not shown) for receiving screws or bolts to attach to the limb ends 40 and 42 via the limb holes 43. The limb brackets 45 and 46 are unthreaded. The limb brackets 45 and 46 are shown attached to the limb ends 40 and 42 in FIG. 5.

Figure 8:
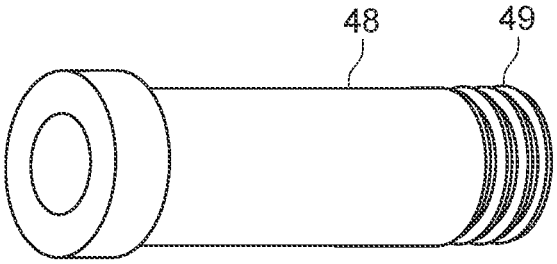
FIG. 8 illustrates a right cam spacer having an internal thread for the axle and an end external thread for a tightening nut.

FIG. 8 shows a cam spacer 48 having internal threads and a threaded end 49.

Figure 9:
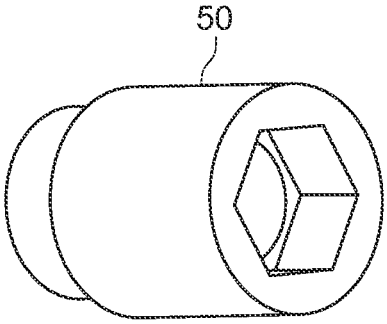
FIG. 9 illustrates a tightening nut.

FIG. 9 shows a nut 50 with internal threads that screw onto the threaded end 49 of the cam spacer 48. There is a similar cam spacer and nut for the other side of the cam.

Figure 10:
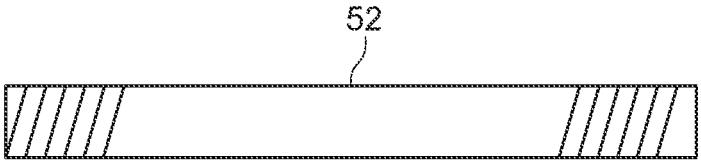
FIG. 10 illustrates a cam axle having threaded ends.
Figure 11:
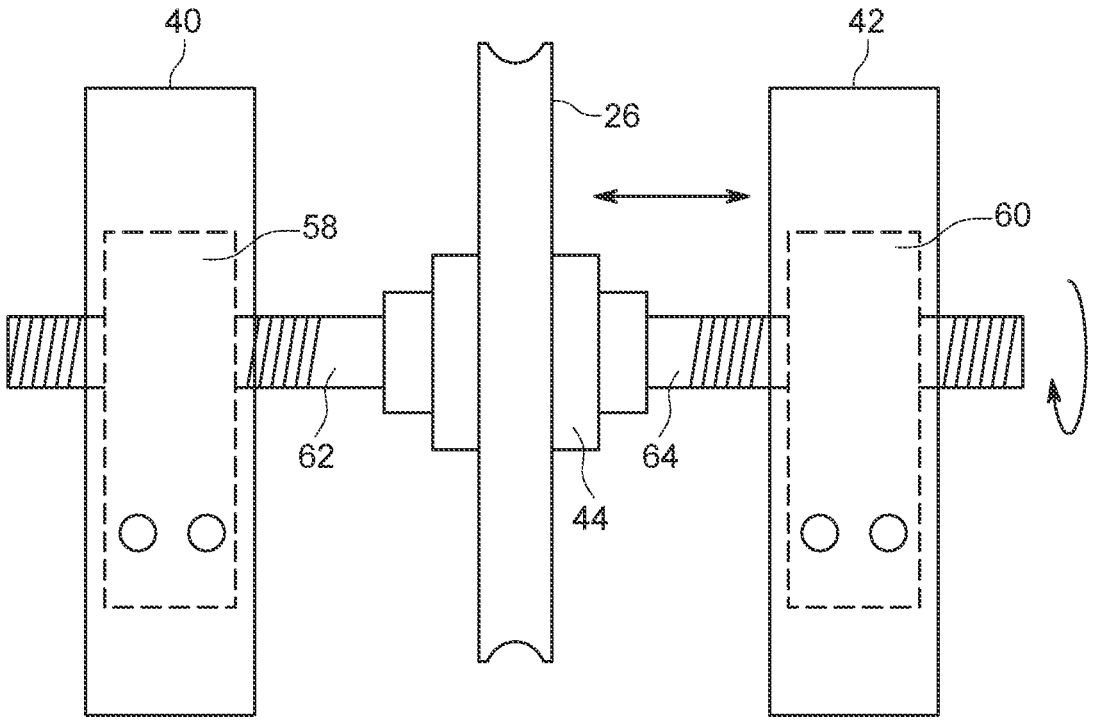
FIG. 11 illustrates another embodiment of the invention using cam spacers with external threads and limb brackets with internal threads.

FIG. 10 shows an axle 52 that has threaded ends. The middle portion of the axle 52 is not threaded. The cam spacer 48 is threaded onto one end of the axle 52. The axle 52 is inserted through the hole in the cam 26 so the cam 26 freely rotates around the axle 52. The threaded end 49 of the cam spacer 48 is put through the hole in the right-side limb bracket 46. An identical cam spacer is screwed onto the other end of the axle 52 so the ends of the cam spacers lightly abut the cam 26. This other cam spacer is put through the hole in the left limb bracket 45. The limb brackets 45 and 46 are then attached to the limb ends 40 and 42. So now the cam spacers 48 can slide left and right through the limb brackets 45 and 46.

To set the position of the cam 26 between the limb ends 40 and 42, the nut 50 is screwed onto the respective threaded ends of the cam spacers 48. By tightening one of the nuts 50 so as to push the nut 50 against the limb bracket 45 or 46, the cam spacers 48 are moved in the direction of the tightening nut 50. In this way, the cam 26 can be shifted to the left or right by tightening one of the nuts 50. The other nut 50 is tightened accordingly. In one embodiment, the nuts 50 have an end-opening for a hex wrench. The nuts 50 may instead be hexagonal so they can be turned with a conventional wrench. No bow press or snap rings is needed, and the cam 26 is positioned precisely without any wobbling.

In another embodiment, the nuts 50 are replaced with a worm gear structure 54 (FIG. 5) that has a rotatable spiral that interacts with the threads 49 of the cam spacers 48 to push or pull the cam spacers 48 left or right. One of the cam spacers 48 can be laterally moved with the worm gear structure 54 and the other one of the cam spacers may have a nut on its end to lock-in the cam position after it is adjusted using the worm gear structure 54.

FIGS. 11-16 show a different embodiment using threaded limb brackets.

Figure 12:
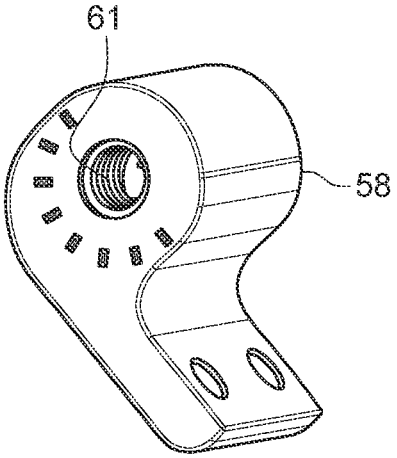
FIG. 12 illustrates a threaded left limb bracket for use in the embodiment of FIG. 11.
Figure 13:
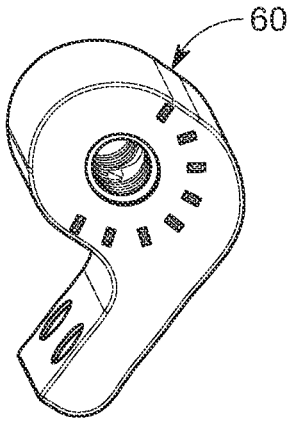
FIG. 13 illustrates a threaded right limb bracket.

FIG. 12 shows a left limb bracket 58, and FIG. 13 shows a right limb bracket 60. The limb brackets 58 and 60 have internal threads 61.

Figure 14:
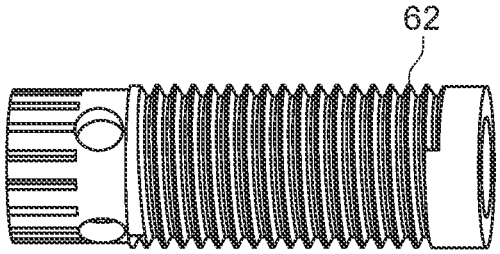
FIG. 14 illustrates a left cam spacer that screws through the left limb bracket.
Figure 15:
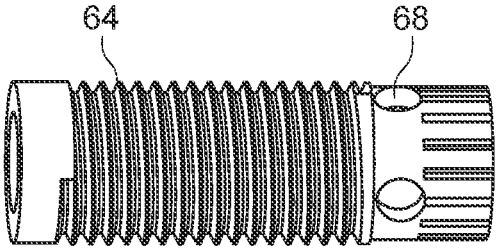
FIG. 15 illustrates a right cam spacer that screws through the right limb bracket.

FIG. 14 shows a left cam spacer 62 that has external threads that screw into the left limb bracket 58, and FIG. 15 shows a right cam spacer 64 that has external threads that screw into the right limb bracket 60.

Figure 16:
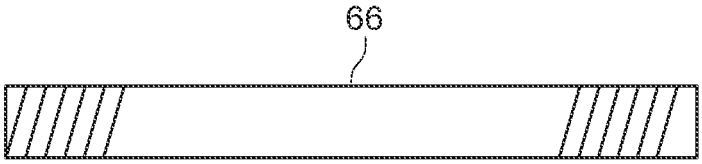
FIG. 16 illustrates an axle having threaded ends.

FIG. 16 shows an axle 66 that is pushed through the hole in the cam 26. The ends of the axle 66 are screwed into the inner threads of the left and right cam spacers 62 and 64.

The outer threads of the cam spacers 62 and 64 are screwed into the limb brackets 58 and 60. The cam spacers 62 and 64 either have a hex opening at their ends for turning the cam spacers, or holes 68 in the sides near the ends of the cam spacers 62 and 64 allow a tool to enter the holes 68 for turning the cam spacers 62 and 64. The ends of the cam spacers 62 and 64 may also be notched to allow the cam spacers 62 and 64 to be turned with pliers.

Once the cam spacers 62 and 64 are installed through the limb brackets 58 and 60, turning the cam spacers 62 and 64 causes the cam 26 to shift to the left or the right for adjustment. No bow press or snap rings is needed.

Figure 1:
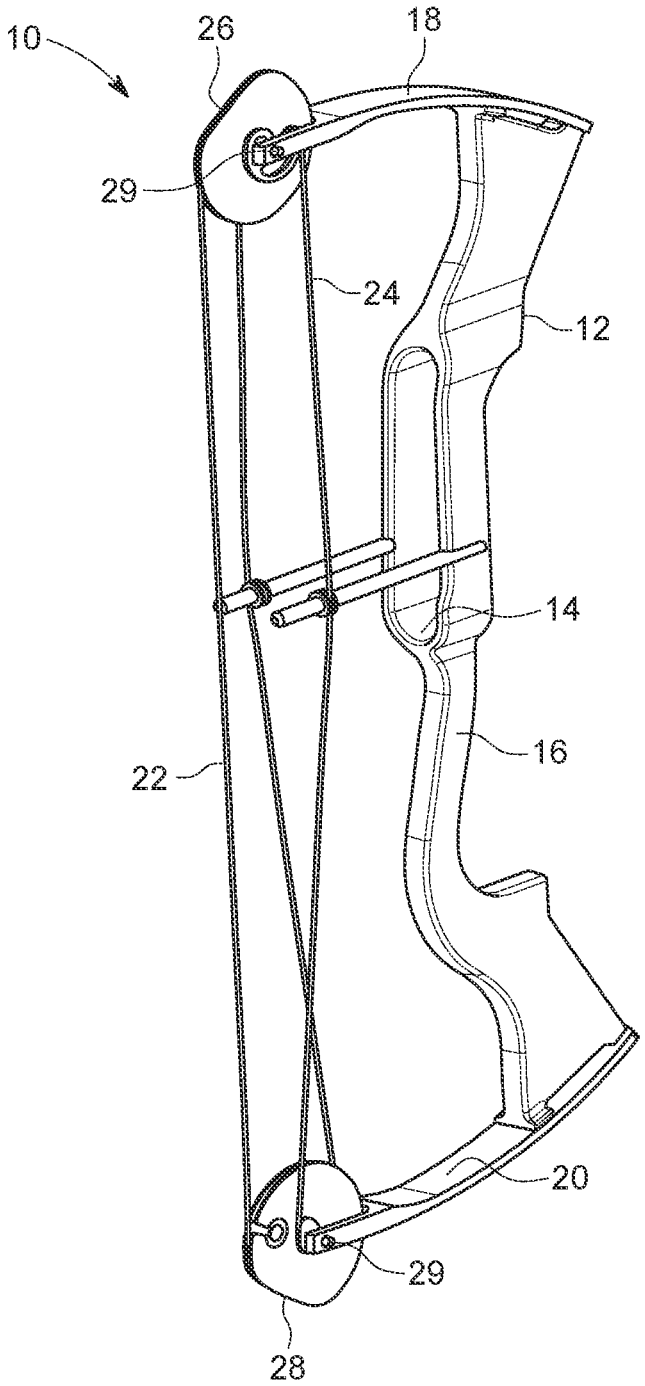
FIG. 1 (PRIOR ART)
FIG. 1 is a side view of a conventional compound bow.
Figure 2:
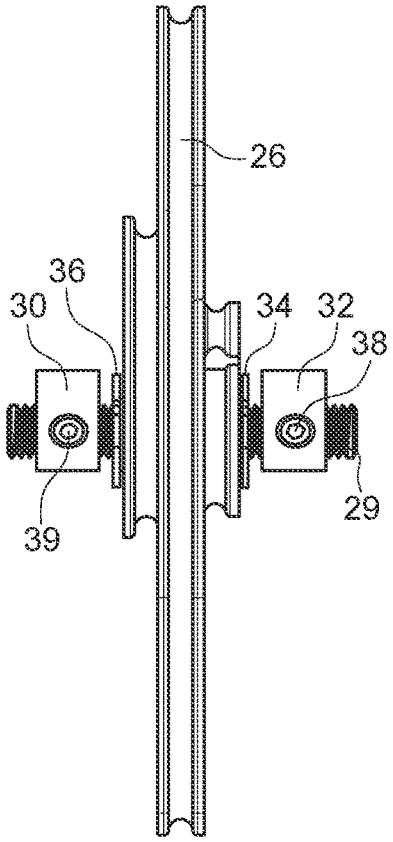
FIG. 2 (PRIOR ART)
FIG. 2 is a front view of a cam and limb brackets attached to the end of a limb in a conventional compound bow.
Figure 3:
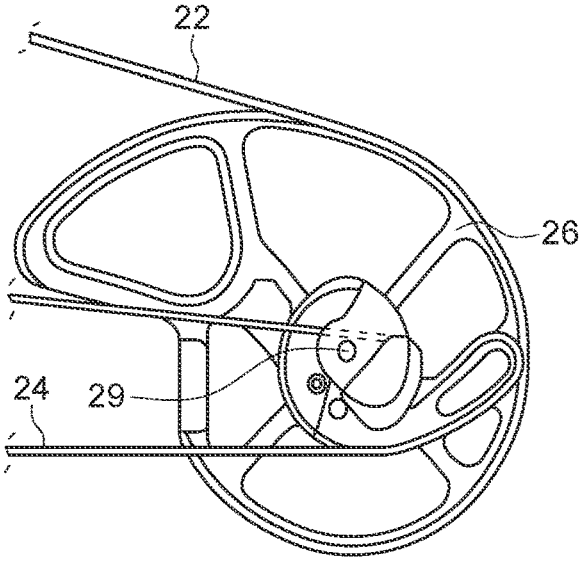
FIG. 3 (PRIOR ART)
FIG. 3 is a side view of a conventional cam.

The cam spacers in the various embodiments are much more reliable than the snap rings of FIG. 2 and better restrict tilting of the cam.

Figure 17:
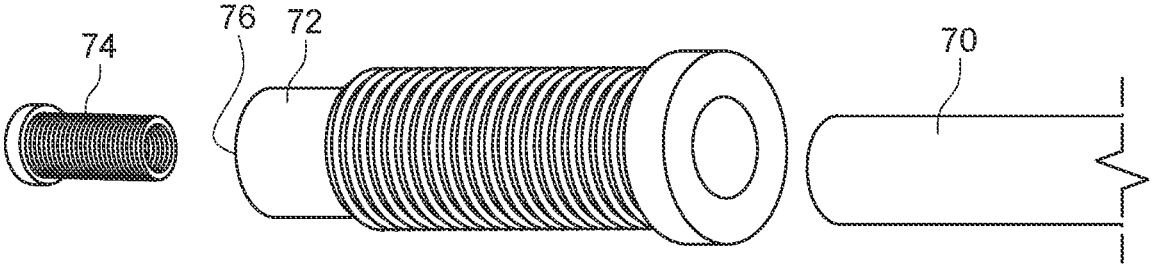
FIG. 17 illustrates another way of attaching the axle to the cam spacers.

FIG. 17 illustrates another way to attach the cam spacers to the axle. The axle 70 has a threaded hole (obscured) in each of its ends. A cam spacer 72 has an outer thread and a smooth bore. The axle 70 extends through the smooth bore. A socket cap screw 74 has outer threads the engage the inner threads of the axle 70 when the axle 70 is inserted through the cam spacer 72 to affix the axle 70 to the cam spacer 72. The socket cap screw 74 may have a hex opening. The left end 76 of the cam spacer 72 has a recessed shelf that abuts the end of the socket cap screw 74 when it is tightened. This recess allows the cam spacer 72 to have a hex opening at its end for turning by an Allen wrench. Alternatively, the cam spacer 72 may have side holes or other means for receiving a tool for turning it. The cam spacer 72 screws into the threaded limb brackets of FIGS. 12 and 13 so that turning the cam spacer 72 shifts the bow cam (mounted on the axle 70) left or right for adjustment.

Another type of compound bow only has one asymmetric cam, and the invention applies equally to those types of bows. Other embodiments are contemplated to perform similar functions.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A compound bow comprising:

a cam;

a resilient limb having a space for mounting the cam;

a first limb bracket and a second limb bracket connected to the resilient limb;

an axle extending through the cam the axle having two opposing externally threaded ends;

a first cam spacer and a second cam spacer, each having internal threads that are screwed onto respective externally threaded ends of the axle to secure the axle to the first cam spacer and the second cam spacer, a first end of the first cam spacer abutting a first side of the cam, and a second end of the second cam spacer abutting a second side of the cam, wherein the first cam spacer has a first external thread and the second cam spacer has a second external thread; and a third end of the first cam spacer extending through the first limb bracket, and a fourth end of the second cam spacer extending through the second limb bracket, whereby the cam is laterally moved within the space in the limb by shifting the first cam spacer and the second cam spacer with respect to the first limb bracket and the second limb bracket.

2. The bow of claim 1 wherein the first limb bracket has a first internal thread that engages the first external thread of the first cam spacer, and wherein the second limb bracket has a second internal thread that engages the second external thread of the second cam spacer, wherein turning the first cam spacer and the second cam spacer laterally moves the cam.

3. The bow of claim 2 wherein the first cam spacer has an opening at its third end for receiving a tool for turning the first cam spacer.

4. The bow of claim 3 wherein the second cam spacer has an opening at its fourth end for receiving the tool for turning the second cam spacer.

5. The bow of claim 1 wherein the first cam spacer has the first external thread only at its third end, and wherein the second cam spacer has the second external thread only at its fourth end.

6. The bow of claim 5 wherein the first limb bracket is not internally threaded and receives the first cam spacer such that the third end of the first cam spacer protrudes through the first limb bracket, and wherein the second limb bracket is not internally threaded and receives the second cam spacer such that the fourth end of the second cam spacer protrudes through the second limb bracket, the bow further comprising:

a first adjustment mechanism that engages the third end of the first cam spacer to laterally move the first cam spacer and the cam; and a second adjustment mechanism that engages the fourth end of the second cam spacer.

7. The bow of claim 6 wherein the first adjustment mechanism comprises an internally threaded first nut that engages the first external thread of the first cam spacer, and wherein the second adjustment mechanism comprises an internally threaded second nut that engages the second external thread of the second cam spacer, wherein turning at least one of the first adjustment mechanism or the second adjustment mechanism moves the first cam spacer or the second cam spacer to laterally move the cam.

8. The bow of claim 6 wherein the first adjustment mechanism has an end with a first hex opening, and wherein the second adjustment mechanism has an end with a second hex opening.

9. The bow of claim 6 wherein the first adjustment mechanism comprises a first worm gear.

10. The bow of claim 6 wherein the second adjustment mechanism comprises one of a nut or a second worm gear.

11. The bow of claim 1 wherein the third end of the first cam spacer has an opening for receiving a tool for turning the first cam spacer to move the first cam spacer with respect to the first limb bracket for laterally moving the cam.

12. The bow of claim 1 wherein the first limb bracket and the second limb bracket are connected to the resilient limb by bolts.

13. A method for adjusting a cam in a compound bow, wherein the bow has a resilient limb with a space for mounting the cam, the method comprising:

providing a first limb bracket and a second limb bracket connected to the resilient limb;

providing an axle extending through the cam the axle having two opposing externally threaded ends;

providing a first cam spacer and a second cam spacer, each having internal threads that are screwed onto respective externally threaded ends of the axle to secure the axle to the first cam spacer and the second cam spacer, a first end of the first cam spacer abutting a first side of the cam, and a second end of the second cam spacer abutting a second side of the cam, wherein the first cam spacer has a first external thread and the second cam spacer has a second external thread;

wherein a third end of the first cam spacer extends through the first limb bracket, and a fourth end of the second cam spacer extends through the second limb bracket; and shifting the first cam spacer and the second cam spacer with respect to the first limb bracket and the second limb bracket to move the cam within the space in the limb.

14. The method of claim 13, wherein the first limb bracket has a first internal thread that engages the first external thread of the first cam spacer, and wherein the second limb bracket has a second internal thread that engages the second external thread of the second cam spacer, the method further comprising:

turning the first cam spacer and the second cam spacer to laterally move the cam.

15. The method of claim 13 wherein the first cam spacer has an opening at its third end for receiving a tool, the method further comprising using the tool for turning the first cam spacer.

16. The method of claim 13 wherein the first cam spacer has the first external thread only at its third end, wherein the second cam spacer has the second external thread only at its fourth end, wherein the first limb bracket is not internally threaded and receives the first cam spacer such that the third end of the first cam spacer protrudes through the first limb bracket, and wherein the second limb bracket is not internally threaded and receives the second cam spacer such that the fourth end of the second cam spacer protrudes through the second limb bracket, the method further comprising:

turning a first adjustment mechanism that engages the third end of the first cam spacer to laterally move the first cam spacer and the cam; and turning a second adjustment mechanism that engages the fourth end of the second cam spacer.

17. The method of claim 16 wherein the first adjustment mechanism comprises one of a nut or a worm gear.

* * * * *